US009717362B1

(12) United States Patent
Birch

(10) Patent No.: US 9,717,362 B1
(45) Date of Patent: Aug. 1, 2017

(54) DRAPERY CARRYING METHOD AND APPARATUS

(71) Applicant: Cliff Birch, Gastonia, NC (US)

(72) Inventor: Cliff Birch, Gastonia, NC (US)

(73) Assignee: Rowley Company, LLC, Gastonia, NC (US)

( * ) Notice: Subject to any disclaimer, the term of this patent is extended or adjusted under 35 U.S.C. 154(b) by 0 days.

(21) Appl. No.: 14/863,842

(22) Filed: Sep. 24, 2015

Related U.S. Application Data

(60) Provisional application No. 62/054,511, filed on Sep. 24, 2014.

(51) Int. Cl.
*E05D 15/00* (2006.01)
*A47H 1/13* (2006.01)
*A47H 1/124* (2006.01)

(52) U.S. Cl.
CPC ..... *A47H 1/13* (2013.01); *A47H 1/124* (2013.01)

(58) Field of Classification Search
CPC ... Y10T 16/35; Y10T 16/3543; Y10T 16/355; Y10T 16/353; Y10T 24/51; A47H 1/00; A47H 1/13; A47H 1/124; A47H 5/02; A47H 5/03; A47H 5/0325; A47H 5/032; A47H 13/00; A47H 13/02; A47H 13/04; A47H 15/00; A47H 15/02; A47H 15/04
See application file for complete search history.

(56) References Cited

U.S. PATENT DOCUMENTS 1,295,141 A * 2/1919 Elliott ..... F16B 15/08 206/346
2,317,531 A * 4/1943 Hudson ..... A47H 15/02 16/87.8
3,359,592 A * 12/1967 Saltz ..... A47H 15/04 16/93 D
3,958,691 A * 5/1976 Schaeffer ..... B65D 73/02 206/326
4,282,630 A * 8/1981 Toder ..... A47H 13/00 16/93 D
4,473,102 A * 9/1984 Ohman ..... A47H 5/032 16/87.4 R
6,082,499 A * 7/2000 O'Donnell ..... E05D 15/12 16/18 R
7,788,769 B2 * 9/2010 Wicker ..... A47H 5/03 16/87.8
7,937,808 B1 * 5/2011 Chuang ..... A47H 15/02 16/106
8,925,149 B2 * 1/2015 Chuang ..... A47H 15/02 16/87.2
2007/0289090 A1 * 12/2007 Cai ..... A47H 15/02 16/87.2
2008/0295299 A1 * 12/2008 Christian ..... A44B 11/00 24/310
2010/0065230 A1 * 3/2010 Hibbs ..... A47H 1/02 160/330
2010/0125987 A1 * 5/2010 Barkun ..... A47H 13/00 24/716

(Continued)

*Primary Examiner* — Chuck Mah
(74) *Attorney, Agent, or Firm* — Sara Centioni Kanos; Nexsen Pruet, LLC

(57) ABSTRACT

A drapery hanging apparatus, method and system including a plurality of carriers, each carrier having a support portion and a pendant for carrying draperies. The carriers are retained by a flexible strip of indefinite length so that the carriers can be fed into a hanger track in a single step.

16 Claims, 9 Drawing Sheets

(56) References Cited

U.S. PATENT DOCUMENTS

| | | | | |
|---|---|---|---|---|
| 2012/0018106 | A1* | 1/2012 | Robledo | A47H 1/04 160/330 |
| 2012/0145860 | A1* | 6/2012 | Ruffo | A47H 13/00 248/251 |
| 2014/0284005 | A1* | 9/2014 | Kao | A47H 13/14 160/84.06 |
| 2015/0129141 | A1* | 5/2015 | Kao | A47H 15/02 160/340 |

* cited by examiner

DRAPERY CARRYING METHOD AND APPARATUS

CROSS REFERENCE TO RELATED APPLICATIONS

The present application claims the benefit of priority of U.S. Provisional No. 62/054,511, filed Sep. 24, 2014, which is incorporated herein by reference in its entirety.

BACKGROUND OF THE INVENTION

The present invention relates generally to drapery carrying devices and methods.

While numerous alternatives exist to address the various problems faced with traverse rod assemblies used for hanging draperies, these assemblies continue to be cumbersome and labor intensive. In particular, drapery rod and track systems typically require manual installation of individual drapery carriers and other suspension components within a track or rod with a semi-enclosed cross section so the assembly can be installed allowing the drapery to hang in a functional and decorative manner. Considering the wide array of drapery configurations and track installation requirements that must be dealt with by manufacturers and fabricators, the track construction process can be very labor intensive. Fabricators are burdened with counting out the individual carriers needed and installing them individually into a track. Certain style carriers must be installed in certain orientation, it is further burdensome for the fabricator to turn and orient each carrier. Furthermore, the packaging of the carriers from the original manufacturer can create issues with the preparation, counting and the installing of the carriers. For example, the use of rigid carrying devices may cause difficulty in separating the carriers from the packaging upon installation. Additionally, a rigid carrying device might be more challenging to transport in bulk and thereby limits the number of carriers that can be included within a given package.

Accordingly, these and other concerns show there remains a need for a method and apparatus that allow for convenient transport and installation of drapery suspension and carrying components.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention; its sole purpose is to present concepts of the invention in a simplified form as a prelude to the more detailed description that is subsequently presented.

The present invention includes an apparatus for carrying drapery treatments along a traverse hanging track. In one embodiment, the apparatus includes a plurality of drapery carriers together with a retainer strip. The carriers can be a ball bearing, a ripple fold roller type, or a friction type carrier, each of which is dimensioned to be received by a plurality of consecutive, spaced openings along the retainer strip. Along the length of the retainer strip are markings spaced apart at consistent intervals, such as before and after every ten openings, to guide the installer as to the number of carriers and length of retainer strip required to complete the assembly of a drapery hanging system.

The dimensions of the carrier in relation to the strip openings is such that the carrier fits snugly, but also movably, within the opening so that it can readily be removed from the strip as necessary.

Preferably, the retainer strip is made of a material flexible enough to allow the strip to be wound around a spool. Additionally, the material used facilitates a snug, yet readily sliding fit with carrier.

The present invention also includes a kit for hanging draperies. The kit can include: 1) a spool of carriers held by a retainer strip as previously described; 2) a hanging track; 3) draperies; and 4) drapery connecting means.

The present invention also includes a method for installing a carrying apparatus for hanging draperies. The method can include the following steps: 1) providing a plurality of drapery carriers held together by a retainer strip as previously described; 2) providing a transverse hanging track having a support channel; 3) determining a number of carriers needed to fill the length of the hanging track support channel; 4) counting out the carriers needed using markings along the retainer strip; 5) cutting the strip at the appropriate length to account for the necessary amount of carriers; 6) feeding the carriers in a single step into the hanging track support channel; and 7) removing the retainer strip once the carriers are in place within the hanging track.

The present invention also includes a method for hanging draperies. The method may include the following steps: 1) providing a plurality of drapery carriers held together by a retainer strip as previously described; 2) providing a transverse hanging track having a channel; 3) providing draperies; 4) determining a number of carriers needed to fill the hanging track channel; 5) counting out the carriers needed using markings along the retainer strip; 6) cutting the strip at the appropriate length to provide the necessary amount of carriers; 7) feeding the carriers in a single step into the hanging track channel; 8) removing the retainer strip; and 9) connecting the draperies to the carriers.

Other features and their advantages will be readily apparent to those skilled in the arts, techniques and equipment relevant to the present invention from a careful reading of the Detailed Description of Preferred Embodiments.

DETAILED DESCRIPTION OF PREFERRED EMBODIMENT

The present invention includes methods, apparatuses and systems relating to drapery hangers. Alternative embodiments of the present invention are illustrated in FIGS. 1-11 and described more fully below.

Figure 1:
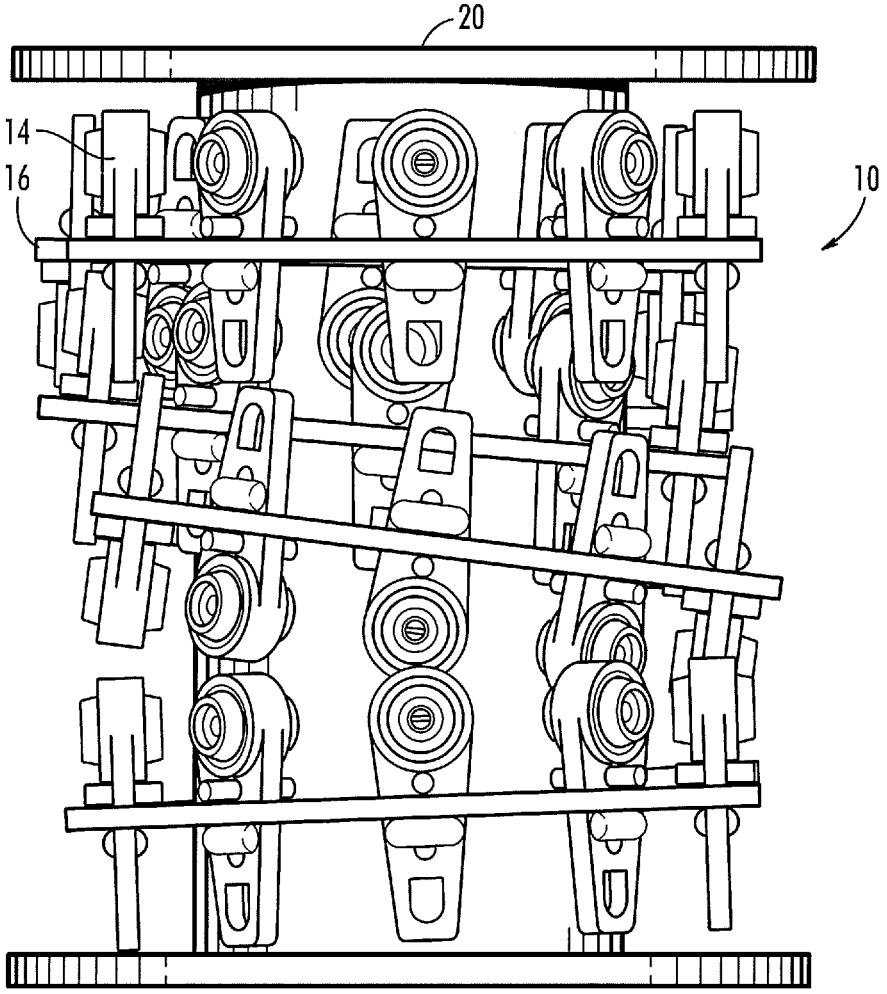
FIG. 1 is a perspective view of a drapery hanging apparatus according to an embodiment of the present invention.
Figure 2:
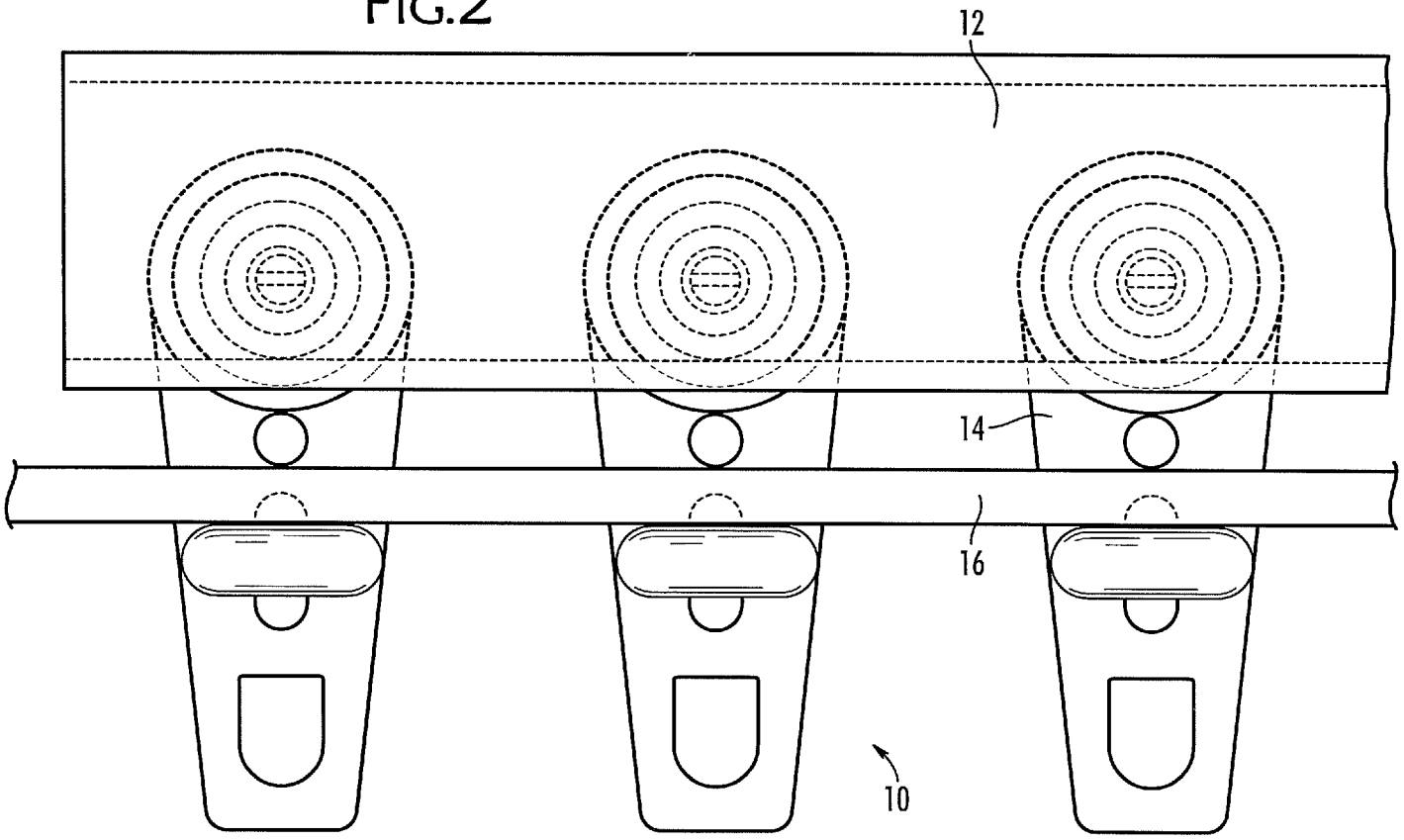
FIG. 2 is a side elevation view of a drapery hanging apparatus according to an embodiment of the present invention.

In one embodiment, shown in FIGS. 1-5, the present invention includes a drapery carrier system 10 for use with a traverse hanging track 12. The drapery carrier system 10 includes a plurality of carriers 14 held by a retainer strip 16. In particular, the carriers 14 are retained by the strip 16 within consecutive, spaced openings 18 along the strip 16. Preferably, the retainer strip 16 is of indefinite length and is about flat, with a greater length than width, and generally has a rectangular cross section. For example, the width of the retainer strip 16 may be slightly greater or about the same as the width of the carriers, and the length of the strip may be indefinite so that a plurality of carriers, at least sufficient to complete multiple drapery hanger systems, can be retained. Further, the strip 16 is made of a flexible material that allows the strip to be bent while still retaining the carriers. As illustrated in FIG. 1, this flexibility enables the carriers 14 and strip 16 to be wound about a spool 20 for storage and/or transport.

The carriers may be a ball bearing carrier, a ripple fold roller carrier, or a ripple fold friction based carrier which is dimensioned to be received by the plurality of consecutive, spaced openings along the retainer strip. In one embodiment shown in FIGS. 1-6, the carrier 14 is ball bearing and includes a carrier body with an upper wheel portion 22 and lower pendant portion 24. The wheel portion 22 includes first and second opposing wheels, 26 and 28, connected through a transverse bore 30. In particular, a first wheel 26 may include an axial male member 32, such as rod, dimensioned to be received by a corresponding axial female member 34, such as bore, on the second wheel, each extending through the carrier bore, respectively. Further, a plurality of ball bearings 36 within the bore encircle and engage the axial male and female members of the wheels.

Figure 5:
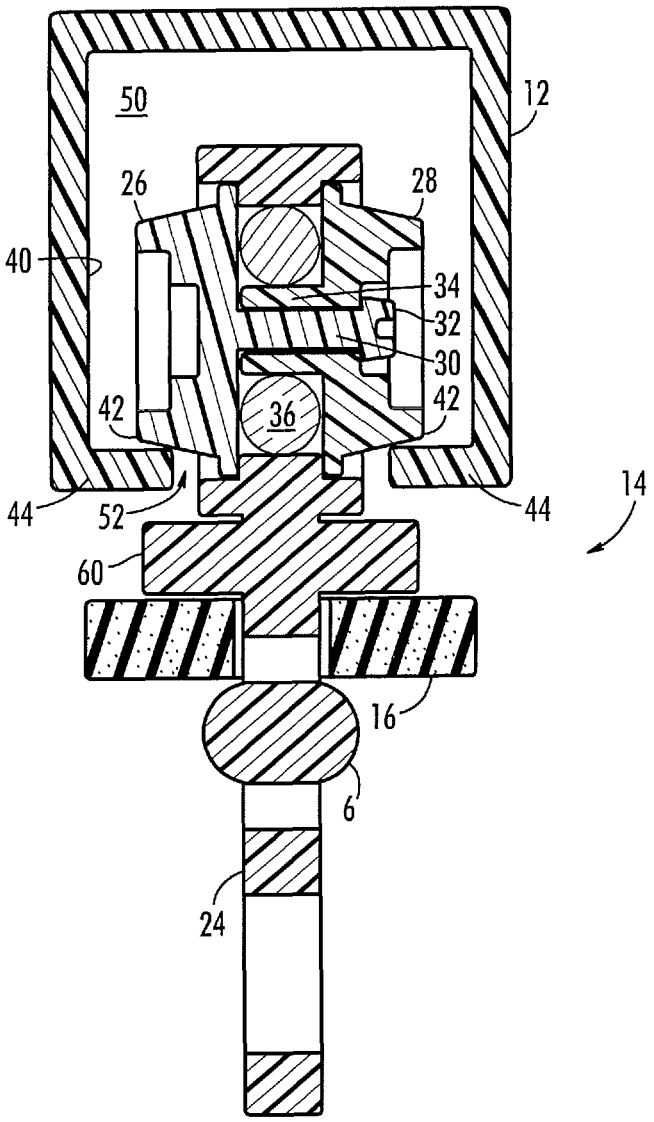
FIG. 5 is a cross sectional view taken at Line 5-5 shown in FIG. 4 of a drapery carrier for use in a drapery hanging apparatus according to an embodiment of the present invention.

The dimensions of the wheels are preferably about the same and facilitate the wheels beginning received by a channel 50 along the interior surface 40 of hanging track 12, as illustrated in FIG. 5. The channel 50 includes a bottom opening 52 that adapted to retain the upper wheel portion 22 of the carrier 14. In particular, the width taken from the end of the first wheel 26 to the end of the second wheel 28 is wider than the bottom opening 52 such that the carrier 14 stays within the channel 50 and is unable to be removed by a downward motion. As shown, the outer surface 42 of the each wheel rests within opposing interior walls 44 of the hanger track 12 so that the carrier 14 sits vertical within the track 12, with the pendant portion 24 extending below the track 12. Other wheel arrangements and features are contemplated by the present invention as alternatives.

Figure 4:
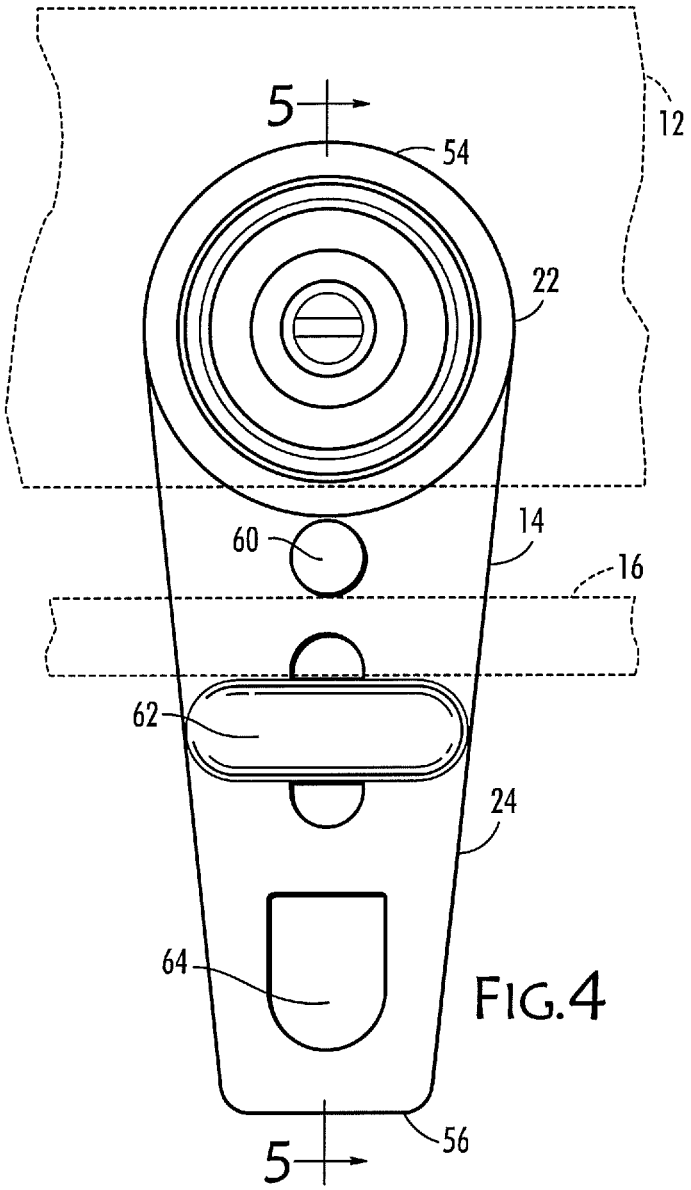
FIG. 4 is a front elevation view of a drapery carrier for use in a drapery hanging apparatus according to an embodiment of the present invention.

The pendant portion 24 of the carrier 14 is slightly tapered in width in relation to the upper wheel portion 22, as shown in FIG. 4, and generally has a round shape at the top 54 of the carrier 14 and rectangular shape 56 at the bottom of the carrier 14. Within the pendant portion 24 are first and second stop members for retaining the carrier within the retainer strip. In particular, the first stop member 60 may be an upper lateral post that extends outwardly from opposing sides of the pendant portion 24, as can be seen in FIGS. 4-5. The post 60 may be monolithic with or connected to the pendant portion 24. The second stop member 62 may be a protruding rib, also extending outwardly from opposing sides of the pendant portion 24. Although the size of the rib may vary, in one embodiment, each rib extends out by a length that is about half the length of each corresponding post. Alternatively, the stop member may be any protuberance, and not only a rib, so long as the size of the protuberance is sufficient to prevent carrier from falling through retainer strip 16 without acting on the strip with purposeful removal force.

When each carrier 14 is inserted within the retainer strip opening 18, the first stop 60 and the second stop 62 work in concert to maintain the carrier 14 in place and to stop the carrier 14 from moving substantially upward or downward along the insertion direction beyond an acceptable range of motion until an installer forcibly removes the strip 16 after installation.

Additionally, the pendant portion 24 includes drapery retaining means, such as openings 64. In one embodiment, shown in FIG. 5, the drapery retaining openings include an opening above and below the protruding rib of the pendant, as well as a third opening along the lower edge of the pendant in relating to the hanging track 12.

Figure 3:
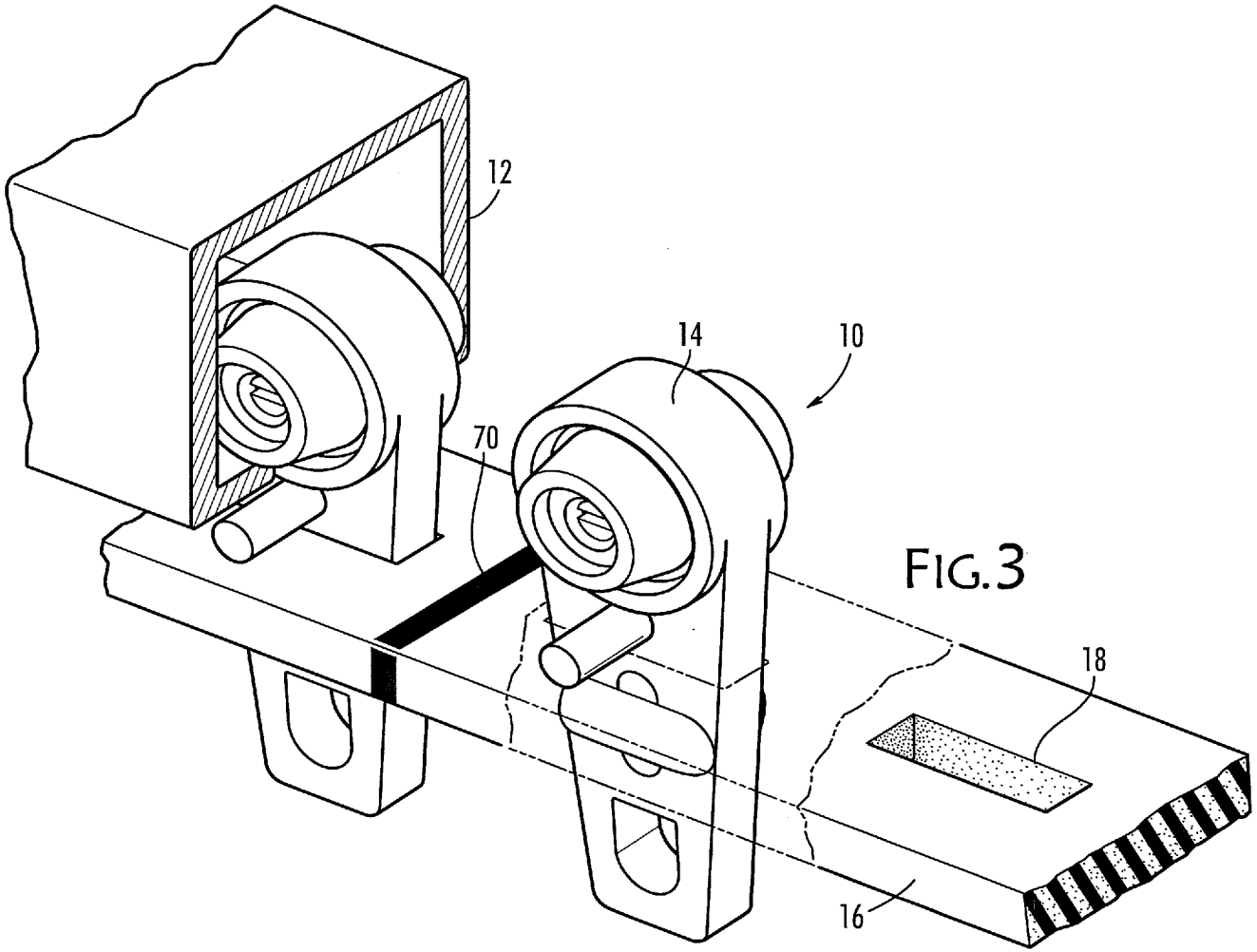
FIG. 3 is a perspective view of a drapery hanging apparatus according to an embodiment of the present invention.

The size and dimension of the of the retainer strip openings 18 are adapted to work in conjunction with the stop members 60, 62 to maintain and/or limit the movement of the carrier 14. In one embodiment, each opening 18 is about rectangular in shape, as shown in FIG. 3. The dimensions, in both lengthwise and widthwise directions, are such that the pendent portion of the carrier 14 is received and fits snugly but movably therein without overly restricting removal of the strip 16 from the carriers 14 once they are connected to the hanger track 12. The carriers 14 and retainer strip 16 are thus slidably and reversibly engaged.

Preferably, the retainer strip 16 is made of a material that allows for flexible movement of the retainer strip 16 from carriers 14, as well as for the appropriate snug, yet readily sliding fit with the carriers 14. In one embodiment, the material is foamed ethylene-vinyl acetate (EVA). Other elastomeric materials are contemplated. Alternatively, the material is a clear and flexible poly-vinyl chloride (PVC) material.

Additionally, the retainer strip includes markings, such as the line marking 70 crossing the width of the retainer strip shown FIG. 3, which delineate the number of carriers between each marking. Moreover, the markings may serve as a guide to the installer on the precise cut to make along the retainer strip 16 for proper insertion into the hanger track 12. These markings may be disposed at convenient intervals for counting, including intervals of two, five, ten, or some other number. Alternatively, the markings can be combined and distinct depending on the interval. For example, at each interval of 2 the color may be blue; at 5, the marking might be the color black, and at each interval of 10, the marking might be the color red.

Figure 7:
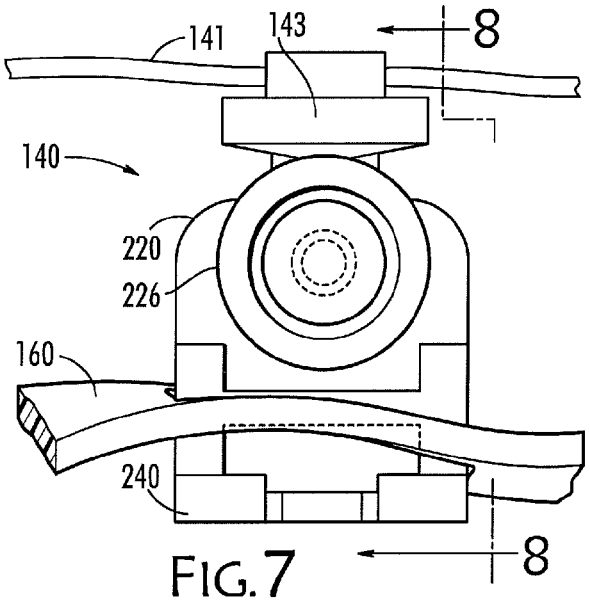
FIG. 7 is a perspective view of a drapery hanging apparatus according to an embodiment of the present invention.
Figure 8:
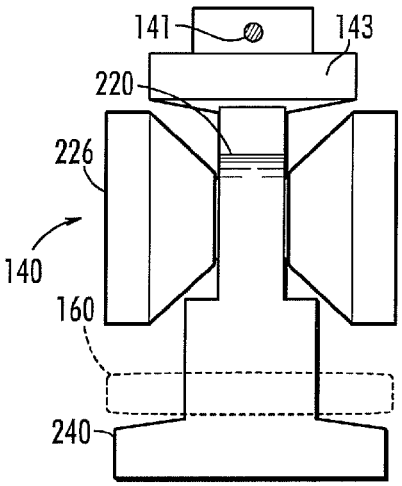
FIG. 8 is a cross sectional view taken at Line 8-8 shown in FIG. 7 of a draper hanging apparatus according to an embodiment of the present invention.
Figure 9:
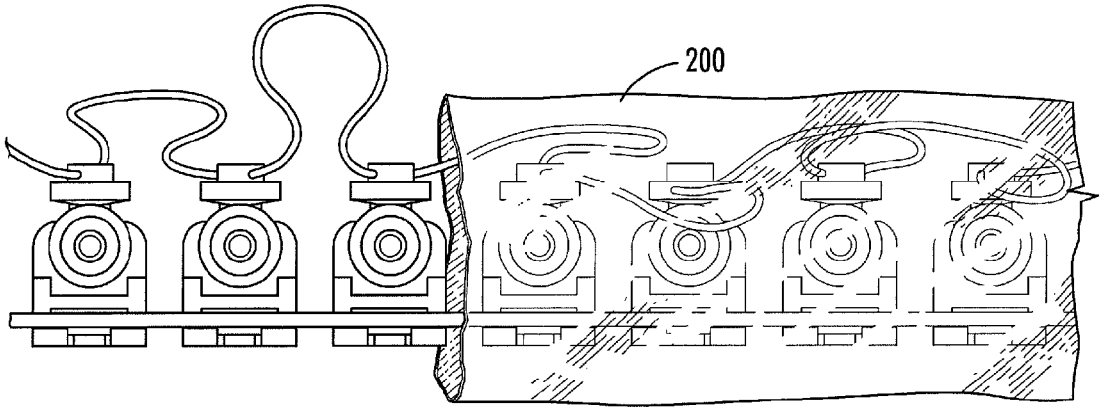
FIG. 9 is a side elevation view of a drapery hanging apparatus according to an embodiment of the present invention.

In an alternative embodiment, shown in FIGS. 7-9, the carrier 140 is a type of ripple fold roller carrier. While these carriers serve similar functions as the ball bearing carriers, they are also used to support a specific set of drapery styles that must maintain proper spacing for the folds of draperies. Thus, a distinction in the ripple fold carrier version includes the use of spacing cord 141 along the top of the carrier 140 that maintains the carriers 140 in spaced relation so as to facilitate the rippling of draperies hung from the carriers. The cord 141 is maintained by a freely rotating cap 143 along the top of the carrier 140.

Similar to the previously described carriers, the ripple fold roller carrier 140 has an upper wheel portion 220 and a lower pendant receiving portion 240. Although the specific details of these portions are different as can be discerned from the Figures, the operation in relation to the retainer strip 160 is similar. In particular, the upper wheeled portion 220 includes opposing wheels, 226, engages the interior of a hanger track (not shown) so that the lower pendant receiving portion 240 sits vertical and below the track so to enable the attachment of draperies and hanging means.

Because of the potential for tangling of the upper spacing cord, another distinction with the ripple fold carrier is that the packaging can include an outer covering 200, such as the sheer plastic wrapping shown in FIG. 9, that will prevent the tangling and will allow for convenient winding of the carrying system about a spool, similar to that shown in FIG. 1.

Figure 10:
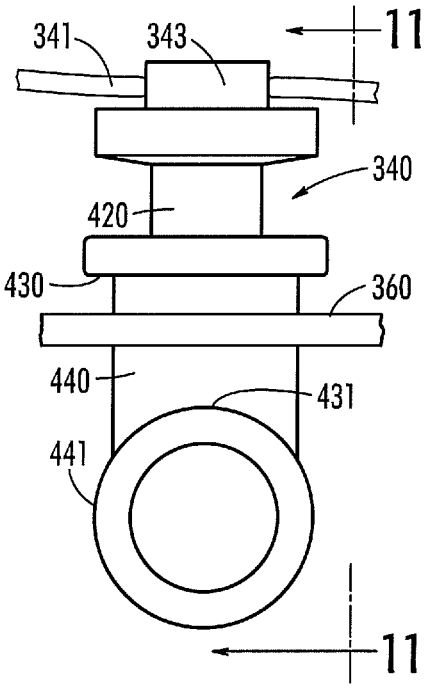
FIG. 10 is a perspective view of a drapery hanging apparatus according to an embodiment of the present invention.
Figure 11:
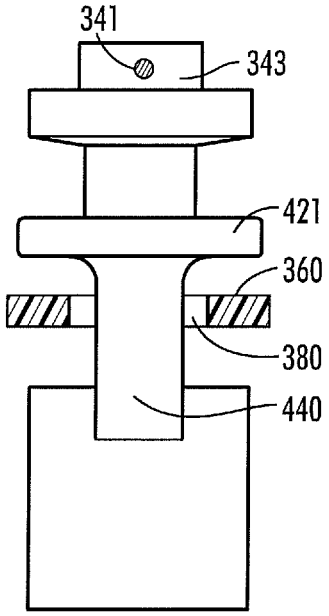
FIG. 11 is a cross sectional view taken at Line 11-11 shown in FIG. 10 of a drapery hanging apparatus according to an embodiment of the present invention.

An alternative ripple fold carrier version, namely, a ripple fold friction carrier 340, is shown in FIGS. 10-11. Similar to the ripple fold roller carrier, the ripple fold friction carrier 340 includes body having an upper portion 420 having a cap 343 that receives a spacing cord 341. A distinction includes the lack of rollers. Rather, the upper portion 420 of this carrier includes a flat flange 421 below the cap and connected to a lower rail portion 440. It is the flat flange 421 feature that frictionally engages the interior surface of a hanger track, analogous to the wheel (roller) portions described above.

At the bottom portion of the carrier 340 in relation to the cap 343 is included a transverse bore 441 having an opening for engaging draperies and drapery hanging means. The rail 440 or central portion of the carrier body is received by the openings 380 along the retainer strip 360 as previously described. Thus, the lower surface 430 of the flange 421 and the upper surface 431 of the bore 441 act as stops to maintain the carrier between them. As with the other versions, the fit between the rail and the retainer openings is snug, yet movable.

The present invention also includes a kit for hanging draperies. The kit may include: 1) a spool of carriers held by a retainer strip as previously described; 2) a hanging track; 3) draperies; and 4) drapery hanging means.

Figures 6A, 6B:
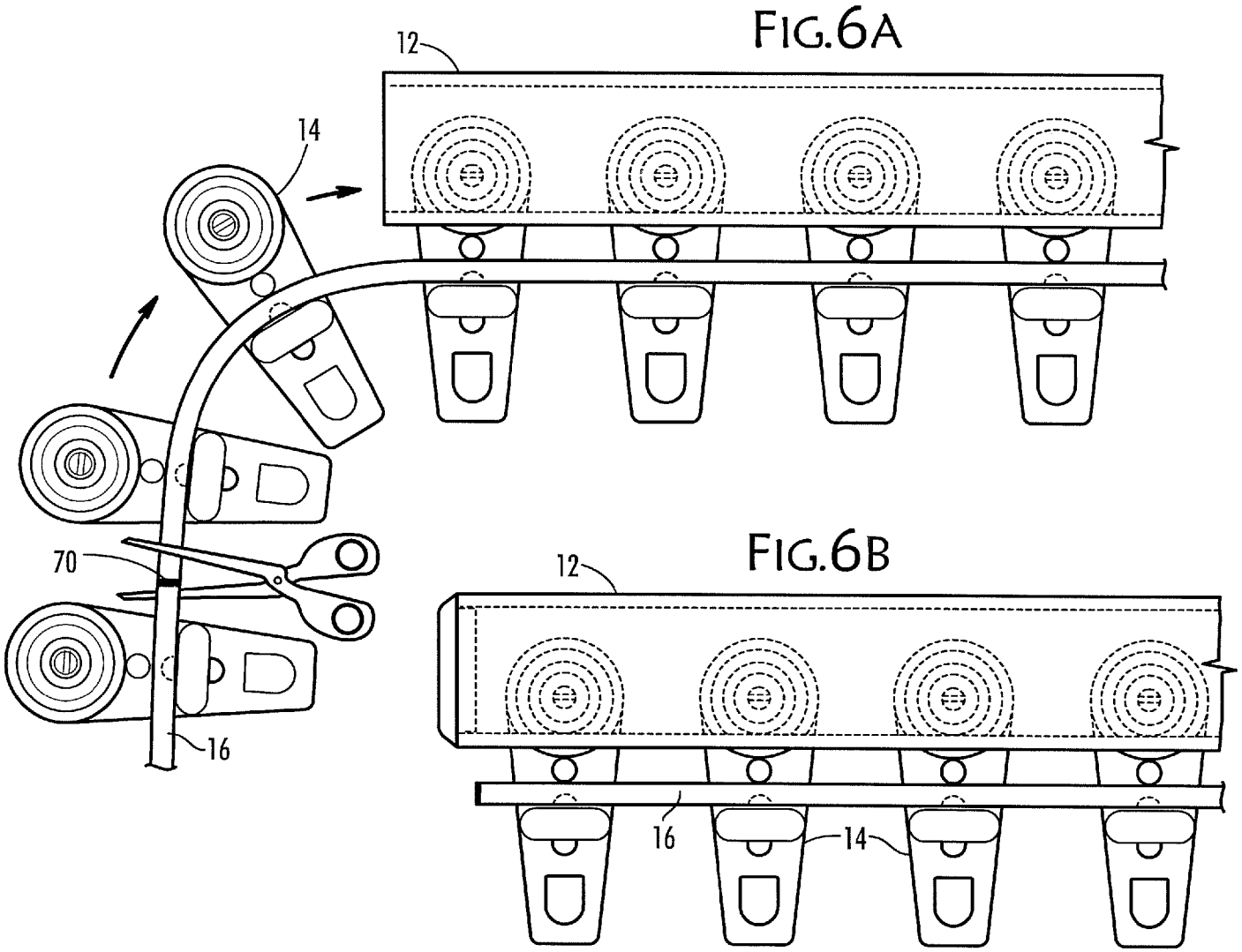
FIG. 6A is a perspective view of a drapery hanging system and method according to an embodiment of the present invention.
FIG. 6B is a perspective view of a drapery hanging system and method according to an embodiment of the present invention.
Figure 6C:
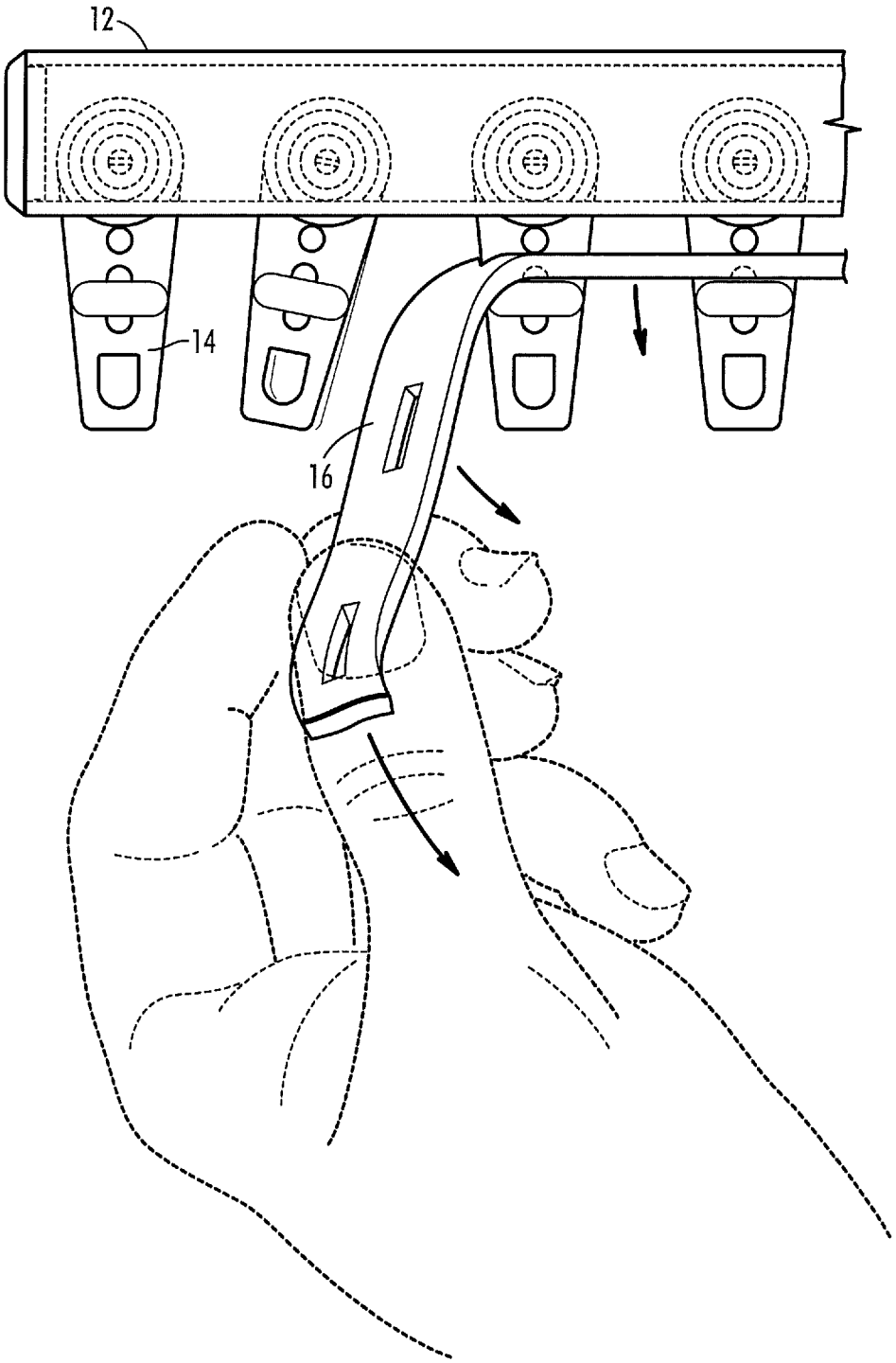
FIG. 6C is a perspective view of a drapery hanging system and method according to an embodiment of the present invention.

The present invention also includes a method for installing a carrying apparatus for hanging draperies. The method, an embodiment of which is shown in FIGS. 6A-6C, includes the following steps: 1) providing a plurality of drapery carriers 14 held together by a retainer strip 16 as previously described; 2) providing a transverse hanging track 12; 3) determining a number of carriers 14 needed to fill the hanging track 12; 4) counting out the carriers needed using markings 70 along the retainer strip 16; 5) cutting the strip 16 at the appropriate length; 6) inserting the carriers 14 and retainer strip at one end of the hanging track; 7) feeding the combined carriers 14 and strip 16 in a single step into the hanging track canal towards the opposing end of the hanging track 12 such that the length of the track 12 includes the requisite number of carriers 14; and 7) removing the retainer strip 16.

The present invention also includes a method for hanging draperies. The method may include the following steps: 1) providing a plurality of drapery carriers held together by a retainer strip as previously described; 2) providing a transverse hanging track; 3) providing draperies; 4) determining a number of carriers needed to fill the hanging track; 5) counting out the carriers needed using markings along the retainer strip; 6) cutting the strip at the appropriate length; 7) feeding the carriers in a single step into the hanging track canal; 8) removing the retainer strip; and 9) connecting the draperies to the carriers.

Those skilled in the relevant arts will appreciate from the foregoing description of preferred embodiments that substitutions and modification can be made without departing from the spirit and scope of the invention which is defined by the appended claims.

What is claimed is:

1. An apparatus for hanging draperies, comprising:

a plurality of carriers held by a retainer strip, wherein each of said carriers includes a support portion and a pendant portion, wherein said retainer strip is about flat with a top surface and a plurality of consecutive spaced openings, and wherein said pendent portions are respectively received by said openings, said pendent portions including first stop members that are adapted to rest on said top surface of said retainer strips, and wherein said openings are adapted to prevent said first stop members from passing beneath said top surface and through said openings.

2. The apparatus as recited in claim 1, wherein said pendent portions includes second stop members.

3. The apparatus as recited in claim 2, wherein each said first stop member is an upper lateral post that extends outwardly from opposing sides of said pendant portion.

4. The apparatus as recited in claim 3, wherein each said second stop member is a protruding rib extending outwardly from opposing sides of said pendant portion.

5. The apparatus as recited in claim 4, wherein said protruding rib extends out by a length that is about half the length of said upper lateral post.

6. The apparatus as recited in claim 1, wherein said pendant portion includes an opening along the peripheral edge of said pendant portion.

7. The apparatus as recited in claim 1, wherein said retainer strip includes markings along said top surface.

8. The apparatus as recited in claim 7, wherein said markings are spaced apart at consistent intervals.

9. The apparatus as recited in claim 8, wherein said consistent intervals are before and after every 10 of said consecutive spaced openings.

10. The apparatus as recited in claim 8, wherein said consistent intervals are before and after every 5 of said consecutive spaced openings.

11. The apparatus as recited in claim 1, wherein said retainer strip is made of foamed EVA.

12. The apparatus as recited in claim 1, wherein said support portion includes a ball bearing wheel.

13. The apparatus as recited in claim 1, wherein said support portion includes a flat frictional surface.

14. A kit for hanging draperies, comprising:

a plurality of carriers held by a retainer strip, wherein each of said carriers includes a support portion and a pendant portion, wherein said retainer strip is about flat with a top surface and a plurality of consecutive spaced openings, and wherein said pendent portions are respectively received by said openings, said pendent portions including first stop members that are adapted to rest on said top surface of said retainer strips, and wherein said openings are adapted to prevent said first stop members from passing beneath said top surface and through said openings;

a spool around which said plurality of carriers held by said retainer strip are wound;

a hanging track;

draperies; and drapery hanging means.

15. A method for installing a carrying apparatus for hanging draperies, comprising the steps:

(1) providing a plurality of carriers held by a retainer strip, wherein each of said carriers includes a support portion and a pendant portion, wherein said retainer strip is about flat with a top surface and a plurality of consecutive spaced openings, and wherein said pendent portions are respectively received by said openings, said pendent portions including first stop members that are adapted to rest on said top surface of said retainer strips, and wherein said openings are adapted to prevent said first stop members from passing beneath said top surface and through said openings;

(2) providing a transverse hanging track;

(3) fixing said transverse hanging track to a support;

(4) determining a number of said carriers needed to fill said hanging track;

(5) counting out said number of carriers along a portion of said retainer strip using markings along said retainer strip;

(6) separating said portion of said retainer strip from the remaining length of said retainer strip;

(6) feeding said portion of said retainer strip holding the required number of said carriers in a single step into the interior of said hanging track so that said retainer strip is below the bottom, outer surface of said hanging track; and (7) removing said retainer strip from said carriers.

16. A method for hanging draperies, comprising the steps:

(1) providing a plurality of carriers held by a retainer strip, wherein each of said carriers includes a support portion and a pendant portion, wherein said retainer strip is about flat with a top surface and a plurality of consecutive spaced openings, and wherein said pendent portions are respectively received by said openings, said pendent portions including first stop members that are adapted to rest on said top surface of said retainer strips, and wherein said openings are adapted to prevent said first stop members from passing beneath said top surface and through said openings;

(2) providing a transverse hanging track;

(3) providing draperies and drapery connecting means;

(4) determining a number of carriers needed to fill said hanging track;

(5) counting out said number of carriers using markings along said retainer strip;

(6) cutting said retainer strip at the appropriate length;

(7) feeding said carriers in a single step into the interior of said hanging track so that said retainer strip is below the bottom, outer surface of said hanging track;

(8) removing said retainer strip; and (9) connecting the draperies to said carriers.

* * * * *